United States Patent [19]

Schroeder

[11] 4,024,404

[45] May 17, 1977

[54] ELECTROLUMINESCENT BACKING SHEET FOR READING AND WRITING IN THE DARK

[75] Inventor: Becky J. Schroeder, Toledo, Ohio

[73] Assignee: Becky J. Schroeder, Toledo, Ohio

[22] Filed: Dec. 9, 1975

[21] Appl. No.: 639,200

Related U.S. Application Data

[63] Continuation-in-part of Ser. No. 567,397, April 11, 1975, Pat. No. 3,978,340, which is a continuation-in-part of Ser. No. 498,705, Aug. 19, 1974, Pat. No. 3,879,611, which is a continuation-in-part of Ser. No. 428,339, Dec. 23, 1973, Pat. No. 3,832,556, which is a continuation of Ser. No. 288,148, Sept. 11, 1972, abandoned.

[52] U.S. Cl. ..... 250/462; 313/498

[51] Int. Cl.² ..... F21K 2/00

[58] Field of Search ..... 250/458, 462, 463; 313/498, 510, 511, 483

[56] References Cited

UNITED STATES PATENTS

| | | | |
|---|---|---|---|
| 2,791,723 | 5/1957 | Nagy et al. | 313/498 X |
| 2,981,858 | 4/1961 | O'Connell | 250/462 X |
| 3,153,745 | 10/1964 | Gurian et al. | 313/511 X |
| 3,252,035 | 5/1966 | Buck, Jr. | 313/498 |
| 3,497,750 | 2/1970 | Knochel et al. | 313/511 X |
| 3,885,196 | 5/1975 | Fischer | 313/498 X |

*Primary Examiner*—Archie R. Borchelt
*Attorney, Agent, or Firm*—Charles F. Schroeder

[57] ABSTRACT

An energy saving electroluminescent backing sheet or panel for back lighting of writing sheets, drawing sheets or sheets having reading or other intelligible matter thereon the backing sheet having a unitarily associated light-weight light activating source capable of providing a low level nondistracting light output which permits its portable use for reading and writing in the dark without need for external light.

18 Claims, 12 Drawing Figures

ELECTROLUMINESCENT BACKING SHEET FOR READING AND WRITING IN THE DARK

This is a continuation-in-part of my co-pending application Ser. No. 567,397 filed Apr. 11, 1975, now U.S. Pat. No. 3,978,340 which is a continuation-in-part application of my application Ser. No. 498,705 filed Aug. 19, 1974, now U.S. Pat. No. 3,879,611, which was a continuation-in-part of my application Ser. No. 428,339, filed Dec. 23, 1973, now U.S. Pat. No. 3,832,556, which was a continuation of my application Ser. No. 288,148, filed Sept. 11, 1972, now abandoned.

This invention relates to an auxiliary or backing sheet for use with writing paper to permit a person to read or to write legibly in the dark with a minimum level of light and a low level of energy consumption.

If one attempts to write in the dark, I have found that although the mechanics of writing can be accomplished with little more than usual effort, writing in straight lines with uniform spacing between lines and without overlap is difficult in the absence of some guide means. According to my present invention I have found that material can be written in the dark with very little light, and that as little light as given off by a backing sheet having phosphorescent material which is activatable by exposure to light or phosphorescent material which is electrically energized close to its threshold of activation is all that is necessary to enable one to write with a pencil or pen in orderly and neat form in the dark.

I have found that a note pad size electroluminescent panel energized by a power source as small as a commercially available pen light cell will provide sufficient backlighting of overlying paper sheets for writing and reading in the dark. According to my invention, since the energy source is small it can be combined directly with the luminescent backing sheet to make it a self-contained portable unit which can be readily inserted under the expanse of a writing sheet. The electrically energized sheet thus can be made into the form of a vest pocket light source or a panel for ready carriage with a writing pad, or incorporated in a clipboard assembly to make it readily accessible for use in the dark.

In this regard, the invention becomes useful in laboratory work where observations are to be conducted in the dark. The invention can be used also in outer space travels where the electrical systems of the spacecraft are required to be shut down for planned periods to permit recharging of equipment. Still further, the invention has practical value in writing in automobiles after dark without the need for internal lighting which has a tendency to distract and disturb the driver.

In view of the foregoing it is an object of the present invention to provide means in the form of a luminescent backing sheet for writing paper which will provide back light in the dark, permitting a writer to write in straight lines without additional light.

Another object of this invention is to provide a portable, lightweight, light source for use in reading and writing in the dark.

Still another object of the invention is to provide a portable back lighting sheet or panel which can be easily produced and readily adapted for reading or writing in dimly lit spaces or in total darkness.

In general, according to my invention, the backing sheet for insertion under the writing paper is a portable electroluminescent sheet having its own power source integral therewith. The electroluminescent sheet lends itself to receipt of guide lines directly thereon or on an overlay sheet, or for some purposes the light intensity may be raised and the guide lines omitted.

The electroluminescent sheet can be made in any of a wide range of sizes and can be made flexible or rigid and of different thicknesses as needs and various uses dictate.

A feature of the invention lies in its low power consumption, and in view of its operability with a small power source at a relatively low voltage it can be made into a simple and safe construction. The portability and low energy consumption of the unit in addition to its thin and capability of flexible construction lend to providing a lighting unit believed to be new in the art.

Other objects and structural features which are believed to be characteristic of my invention are set forth with particularity in the appended claims. My invention, however, both in organization and manner of construction, together with further objects and features thereof may be best understood by reference to the following description taken in connection with the accompanying drawings in which:

Figure 1:
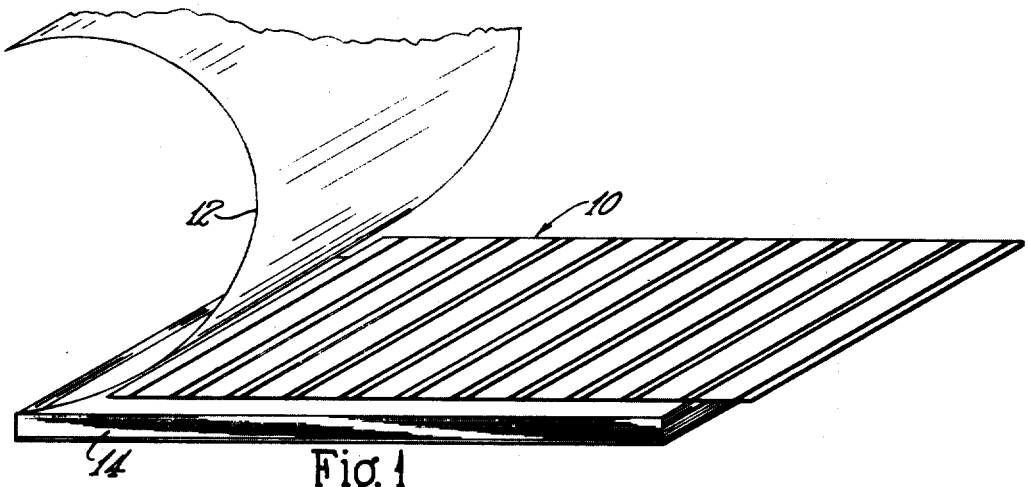
FIG. 1 is a perspective view of a writing tablet with a backing sheet of this invention in partially inserted position under the first paper sheet of the tablet.

Referring to the drawing in greater detail, FIG. 1 illustrates a tablet of writing paper 14 having a top sheet 12 lifted and turned back for insertion of a phosphorescent backing sheet 10 of my invention. As may be seen, the backing sheet can be provided with double lines or extra thick lines if desired.

Figure 2:
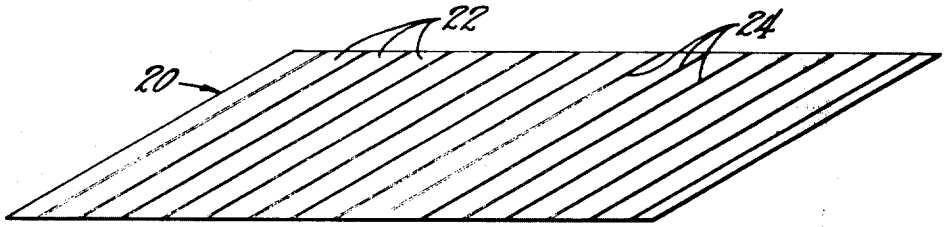
FIG. 2 is a perspective view of a phosphorescent backing sheet of this invention in which the guide lines are non-phosphorescent.

FIG. 2 illustrates a phosphorescent sheet 20 for use with the writing tablet 14 wherein the phosphorescent portions extend over the major portion of the sheet with lines 24 being non-phosphorescent. This sheet can be formed by applying phosphorescent matter in the form of paint or ink over the entire sheet with the non-phosphorescent lines being formed by the absence of phosphorescent material or by an overlay of non-phosphorescent material such as ink or narrow strips of tape. When viewed through the writing paper, written material above the lines is visible against the phosphorescent backing.

Whether or not the writing paper backed by the luminescent sheet of the present invention is lined or unlined, the guide lines enable orderly writing in the dark where ordinarily marked lines are ineffective. Where the writing paper is unlined, sharply marked dark lines on the backing sheet over a phosphorescent base provide guides for orderly handwriting both in the presence of light or in darkness.

Figure 3:
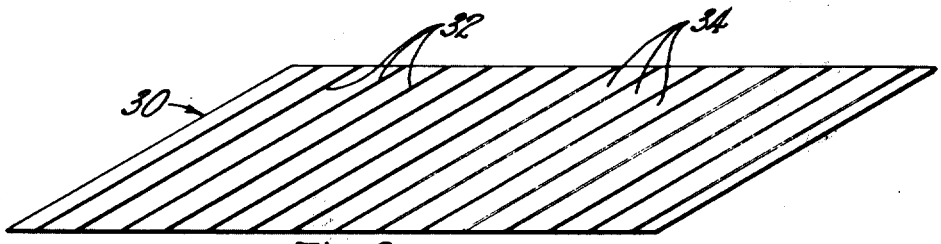
FIG. 3 is a perspective view of another embodiment of my invention in which the guide lines are of phosphorescent material.

FIG. 3 illustrates another embodiment of the invention wherein the backing sheet 30 is provided with parallel phosphorescent lines 32 while the in between portions 34 are non-phosphorescent. This form of the invention has the advantage needing only a minimum of phosphorescent material and is accordingly inexpensive.

Figure 4:
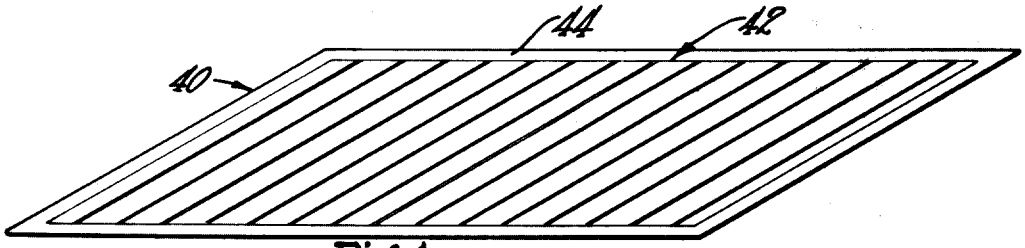
FIG. 4 is a perspective view of another form of my invention in which the phosphorescent portions are embodied in a plastic sheet.

While the phosphorescent backing sheets illustrated in FIGS. 1 to 3 may be any of a number of sheet materials such as ordinary paper, vellum, or even cloth, FIG. 4 is illustrative of a plastic sheet which may be phosphorescent material itself. It might be transluscent or transparent and thermoplastic, enabling encasement of non-phosphorescent line portions, embodied therein. It is perfectly smooth and might be thicker and less flexible than the writing paper itself to facilitate easier writing thereon for greater legibility. The horizontal and marginal lines for the written material might be black or a dark color and non-phosphorescent while the remaining portions of the sheet might be of phosphorescent plastic so that the backing sheet might be utilized either day or night for guidance or handwritten material when the writing paper is placed in overlying relation thereto. That is, by making the guide lines of the plastic sheet contrastingly visible through the writing paper, the sheet can be used for guide purposes under ordinary light as well as in darkness.

The portable luminescent panel of my invention may be an electrically energized panel as well as a light activatable phosphorescent sheet. To activate the light activatable phosphorescent material as a guide for writing in the dark, it is exposed to a light for a period dependent upon intensity of the light. It is found that a sheet of such material requires exposure to ordinary light for a period of only a moment to provide an adequate charge to provide adequate phosphorescence for writing for a period of a quarter of an hour or more.

Figure 5:
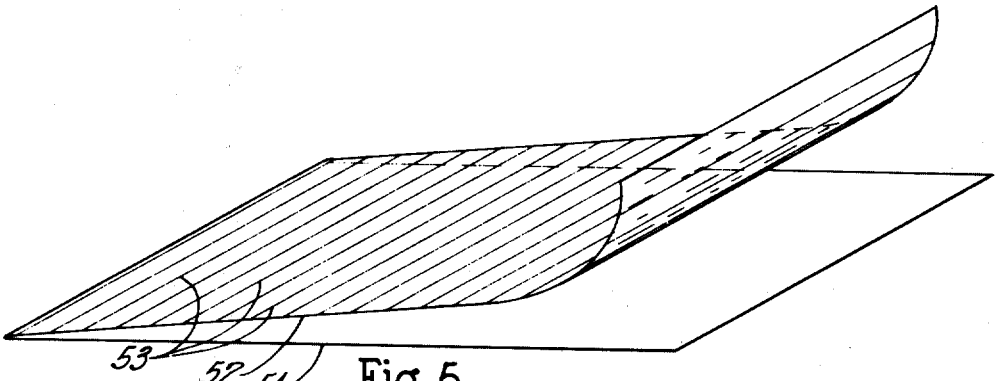
FIG. 5 is a perspective view of still another form of my invention in which guide lines are provided on a transparent sheet assembled with a phosphorescent surfaced backing sheet.
Figure 6:
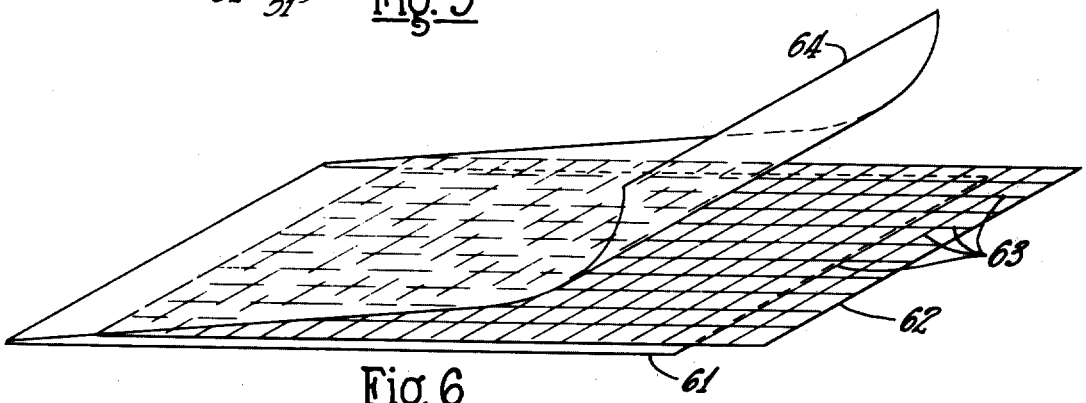
FIG. 6 is a perspective view of another assembly arrangement of my invention in which guide lines are provided on an overlay sheet interposed between a transparent top sheet and a phosphorescent surface member to which it is attached.

In another form of the invention, a luminescent sheet 51 may be assembled as shown in FIG. 5 with a translucent or transparent overlay sheet 52 having relatively opaque guide lines 53 thereon. The assembly can be clipped, adhesively bonded or otherwise suitably secured together with the luminescent sheet, or as shown in FIG. 6 an overlay sheet 62 having guide lines 63 may be held in place between a translucent or transparent top sheet 64 such as of plastic suitably secured along one marginal or edge region of the luminescent sheet 61. This combination provides a flexibility in that the overlay sheet may be replaced with sheets having any number of guide lines arrangements for combination with the phosphorescent sheet, while at the same time being readily placed under writing sheets for guiding application of matter thereto in the dark.

In regard to the foregoing reference herein to written material being visible against the phosphorescent backing, it has been found that reading matter can be readily read in complete darkness if the letters of the reading matter have a sufficient body to be silhouetted against the luminescent background. Thus if handwritten matter is written with a thick line, such as with a felt tip pen, or if printed matter is in letters having line thicknesses providing a bold appearance, reading matter can be read readily against a luminescent background both in lighted as well as in dim and dark spaces. The reading matter if on an overlay sheet of light transmitting material, such as a translucent or a transparent sheet can thus be ready readily in dark spaces such as in hospitals, laboratories or on menus in dimly lit restaurants.

Figure 7:
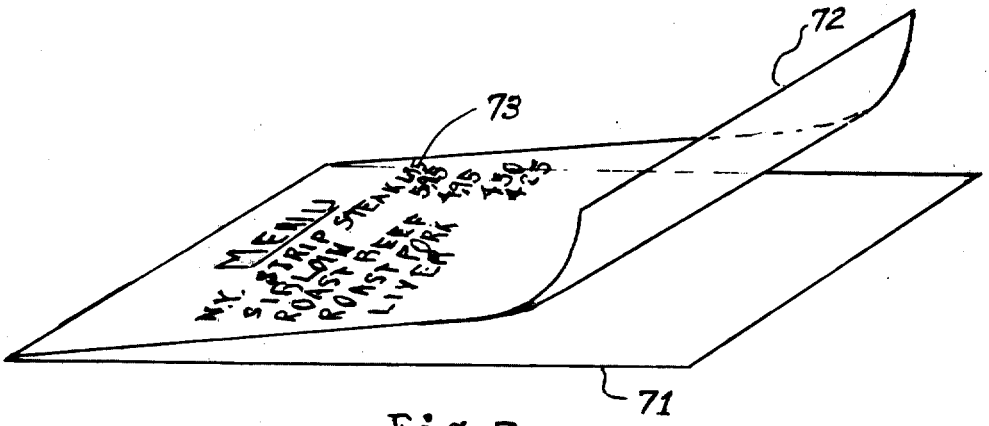
FIG. 7 is a perspective view of still another assembly of my invention in which reading matter is provided on a transparent sheet overlying a phosphorescent surfaced member.

As illustrated in FIG. 7, the letters 73 of the reading matter on the light transmitting overlay sheet 72 may be of ordinary non-glowing matter in black or in color which will provide a ready contrast against the reflective color of the luminescent backing 71 in lighted spaces. It is well known in physics that light is invisible in space and made visible only when transmitted or reflected from a surface. In this regard, where light is present in a space, the reflective color character of the matter to be read in such light can be selected for the desired contrast against the reflective color of the luminescent background sheet in such light. Colors of the letters can thus be selected for their contrasting visibility in ordinary light but in addition, where the reading matter is to be read in dim light or in darkness, the thickness of the lines of the letters are selected so that they can be seen in silhouetted form against the luminescent background. In such case the ordinary non-glowing reading matter will appear black against the luminescent background regardless of its color in ordinary light. I have found that letters written with a line thickness greater than from a little under 1/16 inch width and letters printed in 24 point letter sizes and greater will provide silhouetted forms which can be read quite clearly in darkness against a low light luminescent background as little as one foot lombert or less. In regard, printing such as for menus it has been found provides satisfactory visibility in the dark when in the range of 24–72 point print.

As an alternate to such letters of reading matter being of non-glowing material, fluorescent material can be utilized for the letters entirely or to outline or to interlineate letters or other intelligible matter.

As still another arrangement for ease of reading or greater clarity in darkness, the intelligible matter can be made with phosphorescent material having a contrasting reflective color in ordinary light against the reflective color of the luminescent backing material. The phosphorescent material of the matter can also be selected for its contrasting luminescent color against the color of the background glow.

My above described arrangement has the feature that when printed reading matter is incorporated in a form such as a menu, a light transmitting overlay on which the reading matter is applied can be readily replaced over the more expensive luminescent backing surface. The luminescent assembly thus can need only use a single luminescent backing surface while the overlay menu sheet can be changed inexpensively with each meal change. The replacement sheets can be readily printed on transparent, translucent or ordinary writing sheets in a conventional duplicating machine. The sheets can be associated with a phosphorescent backing surface in a simple holding assembly. In this regard, the holding assembly might be a luminescent backing provided with an overlying outer transparent face which in a sense forms an envelope within which the printed sheet can be merely slipped for use according to the principles of the present disclosure.

Beside reading material on an overly sheet thus being visible as set out above, sketches and images and other intelligible matter such as graphs and grids can also be seen more readily according to the principles set out above.

Still further, phosphorescent matter having different rates of decay can be restored to provide the capability of reading and writing in darkness. In this regard fluorescent and phosphorescent materials having different luminescent decay rates can be incorporated into images to form a composite of the overlay and backing sheet to impart apparent motion to the image. Further in this regard two or more phosphorescent colored materials, or two, three or more fluorescent and phosphorescent materials of different decay rates can be incorporated into an image with very unusual visual results.

Intelligible matter can also be applied to an overlay sheet or on the luminescent surface itself with fluorescent matter matched in its activated and reflective color to the color of the luminescent surface. The fluorescent material thus can be made to blend in with the luminescent background and not be visible when activated such as by a light source. It can be made visible as dark silhouetted matter against the luminescent surface, however, by removing it from exposure to the activating source. This principle of invisibility during activation and visibility in darkness when not activated can also be inverted by blending the color of phosphorescent matter in with a fluorescent background during exposure to an activating source and the continuing glow of the phosphorescent material can be made visible in darkness and in contrast to the non-glowing fluorescent material not under the influence of an activating source.

Figure 8:
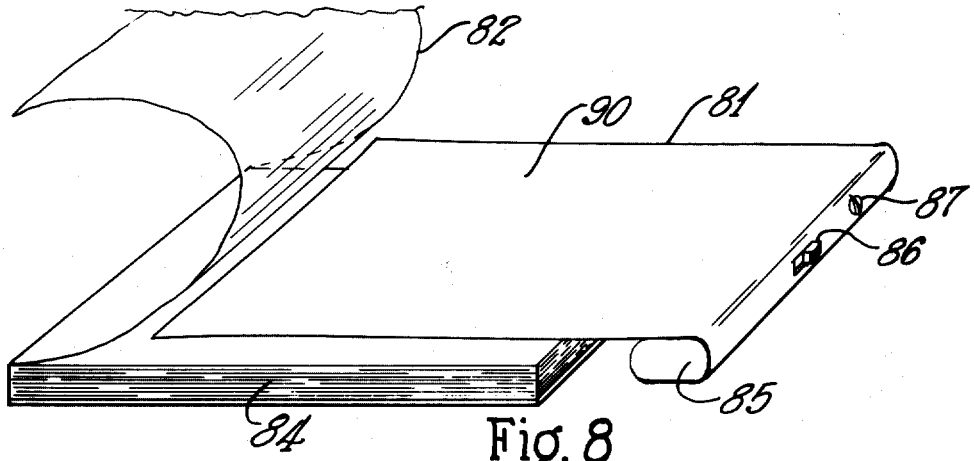
FIG. 8 is a perspective view of a writing tablet with an electroluminescent backing panel of this invention in partially inserted position under the first paper sheet of the tablet.

As shown in FIG. 8 and as described briefly above, the luminescent backing sheet of my invention may be in the form of an electroluminescent sheet or panel 81 having an integral power supply 185 which can be turned on or off at will to provide the light from the light emitting surface 90. The power supply may be placed within a compartment and be of lightweight construction so that the panel can be completely self activated and portable. The panel may be made in various sizes but as shown can be in the form of a thin sheet which can be inserted under the top sheet 82 of a pad of writing paper 84. It can be dimensioned to conform to the area of the writing sheet and can provide as much light as is emitted by the foregoing described light activated phosphorescent sheet or more as desired by provision of a brightness control 87. The panel can be turned on and off at will be an on/off switch 86.

The luminescent sheet can be a phosphorescent sheet which carries a layer of electroluminescent material such as a phosphor like zinc sulfide containing copper or silver added to make it electrically activatable. The layer of luminescent material may be a direct current activatable phosphor material or an alternating or pulsed current phosphor material. In some instances both alternating or pulsed current plus a direct current bias will provide the light output desired.

Since the light output of a electroluminescent panel can be varied such as by varying either the frequency or voltage of the electrical source by way of control such as a voltage control 87, the brightness of the light emitted can be raised to a level such that guide lines may be less needed. Where the light output is dim, however, guidelines can be provided on an overlay sheet as desired over the electro-luminescent sheet.

A unique aspect of the invention is the low level of light which will provide the results desired whereas in the prior art brighter and brighter electroluminescent panels have been sought.

The power supply for the electroluminescent panel 81 can be provided by a commercially available battery, such as a pen-light type dry-cell 88 which activates an inverter circuit 89 to convert the direct current to alternating or pulsed current for activation of the light emitting surface 90. The electroluminescent panels themselves are most frequently constructed with an underlying electrode of conductive material such as a metal plate or a metal foil and an overlying electrode of transparent conductive material between which a phosphorescent material is interposed to be activated by the top and bottom electrodes. The overall assemblage has the properties of a condenser and as such as the power consumption for activation of the phosphor layer is small.

For higher voltages, the thickness of the layer of phosphor must be thick enough to withstand the dielectric stress. For the lower voltages of most commercially available batteries, however the thickness of the dielectric phosphor layer according to the present invention can be reduced considerably thereby reducing the weight of the sheet and allowing it to be more flexible as well as reducing the cost of the assemblage. Thus the present invention lends itself to a low cost production of electroluminescent panels and production of light with very little power consumption. In addition, the lightweight construction lends itself to portability and provision of a pocket size source of light for writing as well as reading in the dark.

The power supply may be incorporated in a compartment integral with the electroluminescent sheet base or in a separate compartment attached to the electroluminescent panel or sheet.

Since the voltages involved in activation of the panel are low and safe for handling without special care, the power supply may be made separate and can be arranged to be clipped-on along an edge region of the panel where the panel itself is provided with marginal regions to expose the top and bottom electrodes for clip-on of the power supply.

Figure 9:
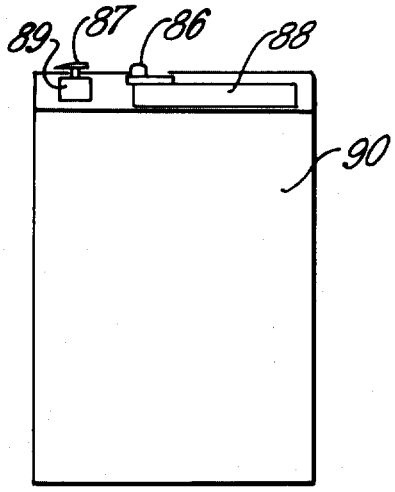
FIG. 9 is a plan view of the backing panel of FIG. 8 showing the location of the battery and associated electric power circuit for activation of the panel.

As shown in FIG. 9, the battery 88 can be a pen-light cell connected to a circuit of small proportions such as a solid-state chip 89 which in turn is connected to the top and bottom electrodes of the panel 81 to activate the light emitting surface 90. The battery and the circuit can be conveniently incorporated in a capsule-like enclosure which can be located at the edge of the panel or sheet. In view of the convenience of this compartmentalized enclosure for the power source, it lends itself to being made integral with or removably secured to the panel. If made integral, it can be molded so as to receive the panel in inserted relation for electrical communication with the circuit. If made removable, the capsule can be arranged to be clipped into place at any of a number of positions along the edge of the sheet where communication with the electrodes is made possible.

The possibility of a relatively low voltage battery operated source allows provision of a lighting sheet which is electrically safe in use and reduces the need for a heavily protected panel and lowers the cost of production. The panel may be made rigid or flexible as desired. It can be made rigid if the base electrode is a metal plate. It can be made flexible if the base electrode is a metal foil. In this regard, the sheet may be made relatively simple in construction with a thin phosphorescent layer disposed between a conductive metal base electrode such as a metal foil and an overlying electrode of transparent conductive material. The thinness of the layer of the electroluminescent material adds to making the sheet flexible which lends itself to being rolled and clipped about the battery or withdrawably placed in a capsule or tube when not in use. In the latter instance, when ready to be used, the flexible sheet can be withdrawn from the capsule to any length desire up to its full length.

Figure 10:
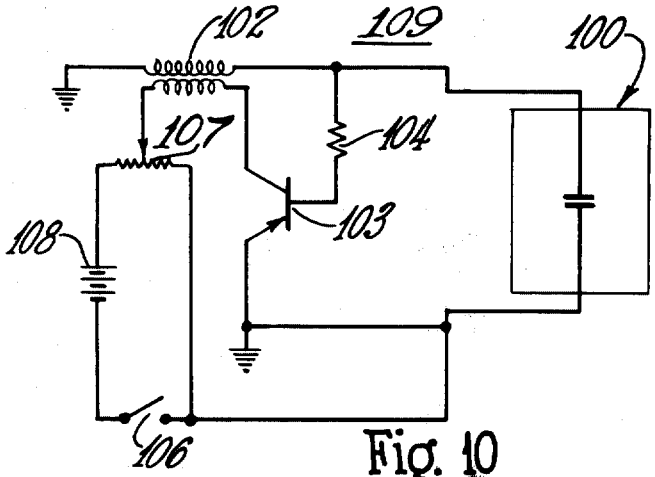
FIG. 10 is a diagramatic illustration of a prior art circuit representative of a battery powered light activating circuit of design which will lend itself to compact, lightweight direct association with an electroluminescent panel according to my invention.

FIG. 10 illustrates a circuit representative of a prior art type of circuit which can be used to activte an electroluminescent panel according to my invention. The circuit is selected for its capability of compact and lightweight construction as well as its simplicity, ruggedness and low manufacturing cost. In the specific arrangement shown, an oscillator 109 includes a transformer 102, a transistor 103, a fixed resistor 104 and a voltage divider 107. A battery 108 which supplies energy to the circuit upon closure of an on-off switch 106 may be a replaceable commercial dry cell. It also can be a rechargeable battery if desired. The direct-current voltage applied to the circuit is converted by the circuit to an alternating-current voltage for activation of the electroluminescent panel 100 represented by a capacitance symbol. Variation of either voltage or frequency of the activating energy will change brightness of light output.

In the circuit of FIG. 10, the voltage divider 107 which enables variation of the activating voltage provides a brightness control for the panel. Alternately, the circuit output to the sheet can be arranged to be varied through a frequency varying control incorporated in the oscillator circuit to permit variation of the light output from the panel. The circuit shown is meant to be only representative since many forms of activting circuits can fulfill the requirements of my invention, including circuits which will provide pulsed energy or alternating energy, or alternating or pulsed energy in combination with a DC biasing voltage, or simple DC energy where the luminescent panel is direct-current activatable.

Figure 11:
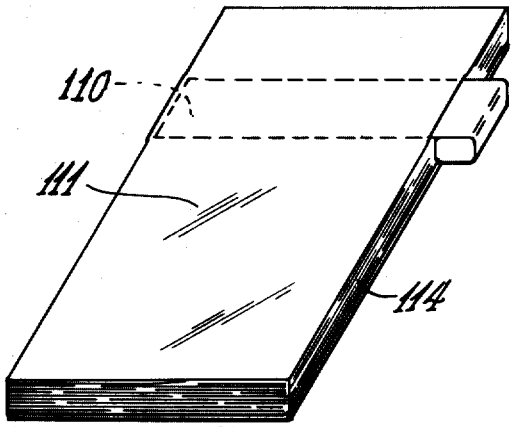
FIG. 11 is a perspective view of an electroluminescent sheet of smaller size than the writing sheet with which it is used illustrating how a small portable pocket size panel with its own power source can be used for backlighting of larger size writing sheets.

FIG. 11 illustrates an electroluminescent panel of my invention which is smaller than the size of the paper on which matter is to be written in the dark. In this arrangement the panel 110 is made generally as long as the width of the writing field of the sheet of paper and has width dimension which will provide a luminescent field sufficient for writing in the dark. As the portion of the paper overlying the panel is filled with written material, the panel can be moved progressively downward to light unused portions of the sheet. In this way a sheet of writing paper 111 of a size such as a pad 114 can be adequately lit with very little light for writing in the dark and with very little consumption of power. The panel can be made of size to fit the pocket and can be used conveniently with a pocket notebook as well. In addition, such a panel can be used for other lighting purposes in the dark, such as lighting the keyhole of a lock when no other source of light is available.

Figure 12:
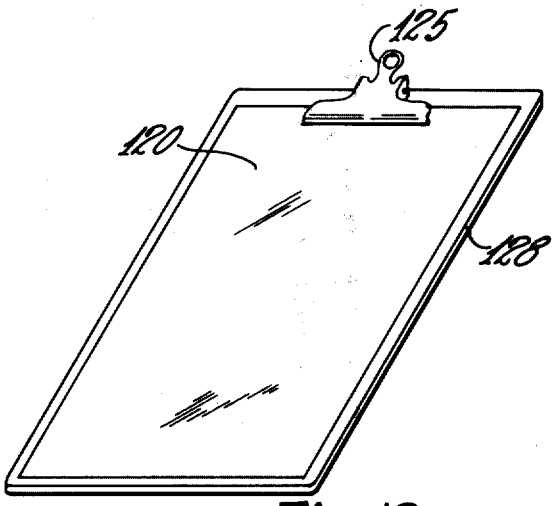
FIG. 12 illustrates an electroluminescent panel of my invention wherein the battery source is integrated in extended relation over the back of the panel.

FIG. 12 illustrates another form of my invention in which the battery 128 is of planar shape underlying the electroluminescent panel 120. The thin planar battery may form a permanent base for the electroluminescent panel and when its effective energy is completely used, the unit may be thrown away. Preferably, however, the battery 128 is arranged to be replaceable with another battery. In such an arrangement the electroluminescent panel 120 might be made in the form of a clipboard with a clip 125 for holding writing paper on which written material is to be applied in the dark. This form of my invention has particular usefulness in hospitals where a patient's records are to be filled in at night by a nurse at the patient's bedside.

In another arrangement of my invention, a light activated sheet can be provided on the back side of the light emitting panel. Thus both a light activatable and an electrically activated luminescent side of the panel can be provided for use in the dark.

Additionally, a thin light-activatable sheet or layer can be provided in overlying relation with the light emitting surface of an electroluminescent panel. The light activatable layer can be made sufficiently thin that light given off therefrom can be both seen as well as activted from the front and back sides of the layer. The electroluminescent light output can thus pass through the light activated layer to permit use of the energized panel while at the same time causing the light activatable layer to become activated so that upon shut-off of the electrical energy, the glow of the light activted layer can continue for use in writing and reading in the dark. In this way, the available energy can be conserved. In addition, the electrical circuit can be arranged to effect an intermittent energization and de-energization of the electroluminescent panel at a frequency to provide a sustained light output fom the combination of light emitting layers for continuous use at desired light output levels. The capacitance of the panel itself might be used as a component of the circuit effecting such energization.

Further in this regard, the electroluminescent material of the electrically activated panel can be provided with a more sustained output or an appreciable persistence such that the frequency and periodicity of activation can be selected for low level power consumption at a desired light output level.

Although the light emitting substance is referred to herein as "phosphorescent material," it will be understood that the invention may utilize any of a number of substances which will glow or emit light and accordingly the terminology "phosphorescent mterial," as used herein is meant to include chemiluminescent, bioluminescent, and solid state materials including any substance which will emit light without an apparent rise in temperature after exposure to a stimulus such as heat, light, or electric current, voltage, electric discharge and electrical signals.

In view of the foregoing it will be understood that many variations of the arrangement of my invention can be provided within the broad scope of principles embodied therein. Thus, while particular preferred embodiments of my invention have been shown and described, it is intended by the appended claims to cover all such modifications which fall within the true spirit and scope of the invention.

I claim:

1. A planar luminescent backing assembly for making readable matter visible in the dark comprising;

a light emitting phosphorescent backing member comprising an electroluminescent panel and a sheet for application of written matter thereon, said sheet being of material through which luminescent light emitted by said backing panel can pass, said light passing sheet being combined in overlying relation with said panel for backlighting and making written matter thereon visibly discernable in the dark.

2. A portable electroluminescent panel assembly for making intelligible matter visible in darkness comprising;

a thin planar member including a layer of luminescent light emitting matter activatable by electric energy and an electrical energy source for activation of said luminescent light emitting matter, said energy source being physically combined in unitary relation with said panel assembly.

3. An electroluminescent panel assembly as set forth in claim 2 wherein the panel comprises a flexible light emitting sheet.

4. A portable planar electroluminescent panel having a light emitting layer electrically activatable to produce light for emission from a light emitting surface and an electrical energy source for activation of said light emitting layer, said electrical energy source being combined in unitary relation with said panel.

5. A portable electroluminescent panel according to claim 4 wherein the electrical energy source is combined in unitary assembled relation with an edge of said panel.

6. A portable electroluminescent panel according to claim 4 wherein the electrical energy source is disposed in underlying relation with the light emitting surface of said panel.

7. A portable electroluminescent panel according to claim 6 wherein the said electrical energy source is a thin panel shaped battery disposed in underlying contiguous relation with said light emitting panel.

8. A portable electroluminescent panel according to claim 4 wherein the electrical energy source comprises a battery and an associated electrical circuit for conversion of direct current energy of said battery to electrical energy which will activate said panel.

9. A portable luminescent panel according to claim 4 wherein the electroluminescent light emitted from said light emitting surface is produced by a layer of matter which is activatable by alternating current energy and wherein said energy source includes a direct current source and an inverter circuit for conversion of energy from said direct current source to alternating current energy.

10. A portable luminescent panel according to claim 4 wherein the electroluminescent light emitted from said surface is produced by a layer of matter which is activatable by pulsed current energy and wherein said energy source includes a direct current source and a circuit for conversion of energy from said direct current source to pulsed current energy.

11. A portable luminescent backing panel according to claim 4 wherein the electrical energy source is adjustable to vary the brightness of light emitted from said panel.

12. A portable luminescent panel according to claim 4 wherein the electrical energy source is adaptable to activate said panel with a biasing voltage in combination with alternating current energy.

13. A portable luminescent panel according to claim 4 wherein the electrical energy source is adaptable to activate said panel with a biasing voltage in combination with pulsed current energy.

14. A luminescent backing panel for guiding the application of matter on light transmissive sheets in darkness comprising an electroluminescent panel having associated in combination with its luminescent surface means providing relatively opaque regions which in the dark are effective to block transmission of light and act as a guide for application of reading matter to light transmissive sheets placed over the activated luminescent surface.

15. An electroluminescent backing assembly comprising electroluminescent matter electrically activatable to produce light for emission from a light emitting surface, and a layer of light activatable light emitting matter effective to permit use of said backing assembly for production of electrically activated light as well as light activated light.

16. An electroluminescent backing assembly according to claim 15 wherein said light activatable layer is activatable by and disposed for activation by electrically produced light of said assembly.

17. An electroluminescent panel assembly according to claim 15 wherein the layer of light activatable phosphorescent matter is disposed in overlying relation with said surface to receive the electrically activated light emitted from said surface, said light activatable layer being sufficiently thin that said electrically activated light will pass therethrough as well as activate the matter of said light activatable layer.

18. An electroluminescent panel according to claim 17 having associated therewith an electrical activating circuit operable with an intermittency such that the light output of said panel is sustained at an overall pre-established desired output level.

* * * * *